US008464372B2

(12) United States Patent
Mitchell

(10) Patent No.: US 8,464,372 B2
(45) **Date of Patent: *Jun. 18, 2013**

(54) LEG ASSEMBLY FOR INFANT ENCLOSURE

(76) Inventor: Christopher Robert Murray Mitchell, Gold Coast (AU)

( * ) Notice: Subject to any disclaimer, the term of this patent is extended or adjusted under 35 U.S.C. 154(b) by 614 days.

This patent is subject to a terminal disclaimer.

(21) Appl. No.: 12/656,254

(22) Filed: Jan. 22, 2010

(65) Prior Publication Data

US 2010/0180377 A1 Jul. 22, 2010

(51) Int. Cl.
*A47D 9/02* (2006.01)
*A47D 9/04* (2006.01)

(52) U.S. Cl.
USPC ..... 5/109; 5/108; 5/101; 5/104

(58) Field of Classification Search
USPC ..... 5/108, 109, 101, 104
See application file for complete search history.

(56) References Cited

U.S. PATENT DOCUMENTS

| | | | | |
|---|---|---|---|---|
| 1,487,341 | A * | 3/1924 | Lange | 5/2.1 |
| 2,338,640 | A * | 1/1944 | Hellier | 340/388.7 |
| 3,043,294 | A * | 7/1962 | Neff | 601/61 |
| 3,225,365 | A | 12/1965 | Miller | |
| 3,295,079 | A * | 12/1966 | Brown | 335/255 |
| 3,802,003 | A | 4/1974 | Laurieti | |
| 3,849,812 | A * | 11/1974 | Walsh | 5/108 |
| 3,874,011 | A * | 4/1975 | Walsh et al. | 5/108 |
| 3,952,343 | A * | 4/1976 | Wong | 5/109 |
| 4,491,317 | A * | 1/1985 | Bansal | 472/119 |
| 4,667,358 | A * | 5/1987 | Penterman | 5/674 |
| 4,793,010 | A | 12/1988 | Gross et al. | |
| 5,636,651 | A * | 6/1997 | Einbinder | 135/67 |
| 5,673,445 | A * | 10/1997 | Suter | 5/400 |
| 5,742,960 | A | 4/1998 | Shamir | |
| 5,794,639 | A * | 8/1998 | Einbinder | 135/67 |
| 6,378,940 | B1 * | 4/2002 | Longoria et al. | 297/217.3 |
| 6,884,226 | B2 * | 4/2005 | Pereira | 601/54 |
| 6,971,127 | B2 | 12/2005 | Richards | |
| 7,234,177 | B1 * | 6/2007 | Drevitson et al. | 5/120 |
| 7,493,666 | B2 | 2/2009 | Mitchell | |
| 7,551,100 | B1 * | 6/2009 | Salley et al. | 340/692 |
| 7,555,791 | B1 * | 7/2009 | Pereira | 5/101 |
| 7,685,657 | B1 * | 3/2010 | Hernandez et al. | 5/109 |
| 8,029,377 | B2 * | 10/2011 | Velderman et al. | 472/119 |
| 2004/0123383 | A1 * | 7/2004 | Nguyen | 5/109 |
| 2004/0244111 | A1 * | 12/2004 | Williams | 5/109 |
| 2007/0129596 | A1 * | 6/2007 | Dickie | 600/26 |
| 2007/0199147 | A1 * | 8/2007 | Mitchell | 5/109 |
| 2007/0277309 | A1 * | 12/2007 | Shane et al. | 5/109 |
| 2008/0060129 | A1 * | 3/2008 | Massa | 5/104 |
| 2009/0151069 | A1 * | 6/2009 | Shane et al. | 5/109 |
| 2010/0180377 | A1 * | 7/2010 | Mitchell | 5/109 |

FOREIGN PATENT DOCUMENTS

| | | |
|---|---|---|
| DE | 4300425 | 7/1994 |
| DE | 29817858 | 10/1998 |
| DE | 10104152 | 6/2002 |
| FR | 2317149 | 3/1977 |
| RU | 2055511 | 3/1996 |

* cited by examiner

*Primary Examiner* — Robert G Santos
*Assistant Examiner* — David E Sosnowski
(74) *Attorney, Agent, or Firm* — Stein IP, LLC

(57) ABSTRACT

A leg assembly for use as at least one supporting leg of an infant enclosure or other device, the leg assembly having an elongated leg member, a solenoid actuator having a coil adapted when the actuator is actuated to move longitudinally relative to the armature of the solenoid actuator and a compression spring which is resiliently compressed upon movement of the coil which imparts motion to the leg member in a vertical direction.

9 Claims, 3 Drawing Sheets

LEG ASSEMBLY FOR INFANT ENCLOSURE

TECHNICAL FIELD

This invention relates to leg assembly and in a particular aspect to a leg assembly for use as a leg or legs of an infant enclosure such as a cot, pram or stroller which incorporates a device to effect or facilitate movement of the enclosure for the purpose of encouraging sleep of babies or infants therein. In a further aspect, the present invention relates to a foot assembly typically in the form of a castor wheel assembly which may be attached to a leg of an infant enclosure to form a leg assembly of the above type. The present invention also relates to an infant enclosure incorporating a leg assembly of the above type.

BACKGROUND ART

It is common where it is desired to induce sleep by a baby or infant to subject the baby or infant to a rocking or other similar motion. It is also known that the motion of a vehicle is particularly effecting in encouraging a baby or infant to sleep. Where a baby or infant is located in a pram or stroller, a mother or person having the care of the infant or baby often will move the pram back and forward by hand in an attempt to induce the baby or infant to sleep. This obviously is a tedious and not always effective task as a simple backwards and forwards motion is often not sufficient to achieve the desired results.

U.S. Pat. No. 7,493,666, discloses an apparatus for moving or rocking an infant enclosure such as a cot which includes four modules on which each leg of the cot is seated with one of the modules being driven to impart a rocking type motion to the enclosure.

While this apparatus functions efficiently, there is a need to have an infant enclosure which does not require separate modules for supporting the cot legs and which has motion imparting means incorporated therein.

SUMMARY OF THE INVENTION

The present invention aims to provide a leg assembly typically but not exclusively suited for use with for an infant enclosure or other device which can be actuated for the purposes of inducing sleep in an infant or baby within the enclosure or otherwise moving the enclosure or device. The present invention in a further aspect aims to provide a foot assembly typically a castor wheel assembly which is attachable to the leg of an infant enclosure to form a leg assembly for the above purpose. In yet a further aspect, the present invention aims to provide an infant enclosure having one or more legs defined by a leg assembly of the above type or a foot unit incorporated or attached to a leg thereof. Other objects and advantages of the invention will become apparent from the following description.

The term "infant enclosure" as used throughout the specification includes a pram, stroller or other mobile baby or infant carrier which usually has at least a three-point support defined by respective legs. Most commonly prams, strollers or other mobile carriers have at least three or four legs terminating in respective wheels defining a three- or four-point support. The term "infant enclosure" also includes stationary enclosures such as cots, cribs or beds having at least two legs. Typically cots, cribs or beds have four legs providing a four point support however cots, cribs or beds may only have two legs which for example provide a continuous support along opposite sides or ends of the enclosure. The term "infant enclosure" further includes stands for cots, cribs, beds, bassinets or the like which usually have at least a three point support, for example three or more legs.

The term "legs" as used throughout the specification in relation to the enclosure includes any form of support by which the enclosure can be supported on an underlying support surface.

The present invention thus provides in one aspect, a leg assembly for use as at least one supporting leg of an infant enclosure or other device, said leg assembly having:

an elongated leg member having a longitudinal axis, an actuator having an actuator member adapted when the actuator is actuated to move longitudinally relative to said longitudinal axis, a resiliently or elastically compressible device adapted in use to be resiliently compressed upon movement of the actuating member to impart a motion to leg member and thereby to said enclosure or other device, and a device for selectively actuating said actuator means.

The leg assembly by the incorporation of the actuator means comprises an active leg assembly. The actuator means may be located at any position along the leg member and incorporated in the leg member. Typically however, the actuator means is provided at the lower end of the leg member and is provided in a foot assembly attached to the lower end of the leg member so as to be interposed between the lower end of the leg member and a support surface such as a floor on which the infant enclosure is located. The foot assembly may comprise a castor wheel assembly as referred to below.

Preferably the actuating member is adapted to undergo a vertical or substantially vertical motion when actuated such as to impart in the leg member a similar movement.

The actuator suitably includes first and second actuator members. One actuator member is suitably fixed to the leg member and the other member is movable in a longitudinal direction relative to the one member.

Most preferably the actuator means comprises a solenoid actuator with the first and second actuator members comprising an armature and a coil. Most preferably the movable actuator member comprises the coil of the actuator which is movable relative to the armature of the actuator. The coil is of a generally cylindrical configuration and of annular form in cross section and surrounds the armature and preferably the coil is weighted so as to increase its momentum when moved. The weight suitably comprises an annular weight which surrounds the coil. Preferably the armature extends longitudinally of the longitudinal axis of the leg member and the coil moves substantially vertically in opposite directions along the armature. When current is applied to the coil, the coil suitably moves vertically upwardly relative to the armature. When current is removed from the coil, the coil suitably drops under the influence of gravity. Preferably the momentum of the coil when dropping causes partial compression of the resiliently or elastically compressible means and that movement is applied as a vertical downward movement to the leg member. Expansion of the resiliently or elastically compressible device upon release of the compressing force causes vertical upward movement of the leg member. A device may be provided to cushion movement of the coil. The device may comprise one or more springs by which the coil is suspended.

In a preferred form, the resiliently or elastically compressible device is provided between upper and lower support members. Preferably the resilient or elastically compressible device comprises a coil spring which is arranged coaxially relative to the longitudinal axis of the leg member. Preferably at least one support member is mounted to the leg member of the leg assembly and the other support member is longitudinally aligned relative to the longitudinal axis of the leg member with the other support member. The leg member suitably has a lower end and the upper support member is attached to the lower end. Typically the attachment is by means of a spigot or pin on the upper support member which is received in a hole or bore in the leg member.

Preferably the solenoid actuator is located centrally within the coil spring. In a particularly preferred form, the leg assembly includes a castor wheel. The castor wheel is typically mounted to the lower support member of the leg assembly in alignment with the longitudinally axis of the leg member. In one form, a plurality of castor wheels are provided, the castor wheels being arranged laterally relative to the longitudinal axis of the leg member and being circumferentially spaced from each other.

In an alternative configuration, the actuator member comprises the armature or an extension of the armature of the solenoid actuator and the coil is fixed against movement. Thus the coil maybe fixed to the upper support member and the armature may be suspended therefrom and move relative to the coil when a current is applied to the coil.

In another aspect, the present invention provides a leg assembly which comprises a passive leg assembly which include a device for facilitating the continuation of motion in the enclosure imparted by the actuator means of the active leg assembly. The device for facilitating the continuation of motion in the enclosure may comprise springs or other resilient or elastic device such as pads of resiliently or elastically deformable material such as pads or rubber or plastics or other devices with similar properties. The passive leg assembly may be of similar construction to the active leg assembly with the resiliently or elastically compressible device such as a coil spring provided between and fixed to the upper and lower support members.

The means for selectively actuating the actuator suitably comprise a device to control the actuator means to enable actuation thereof as required. The actuator may be connectable to a remote power source such as mains power or may be connectable to a battery supply which may be incorporated in the leg assembly.

The active leg assembly may comprise more than one leg of the enclosure to impart motion to the one or more legs. The motion imparted by the active leg assembly to one leg may be different from the motion imparted by the active leg assembly to the one or more of the other legs of the enclosure. The differences in motion may comprise a difference in frequency of motion or difference in extent or amplitude of motion. The motion imparted by one of the active leg assemblies may be in phase with the motion imparted by one or more of the other active leg assemblies or out of phase with that motion. Each leg of the enclosure may comprise an active leg assembly.

Where the apparatus includes more than one active leg assembly, the actuator of each active leg assembly may be actuable independently of the actuation of the actuators of the other active leg assemblies. Preferably also the motion imparted by the actuator of each active leg assembly means is different from the motion imparted by the actuator of each of the other active leg assemblies.

Two or more actuators of the active leg assemblies may be actuated to impart a particular motion in the enclosure. For example, the actuator of the active leg assemblies on one side of the enclosure may be actuated simultaneously in phase and actuator of the active leg assemblies means on the other side of the enclosure also actuated simultaneously in phase but out of phase with the actuator on the one side of the enclosure to impart a side to side rocking motion in the enclosure. Alternatively, the actuator of the active leg assemblies at opposite ends of the enclosure may be actuated in a similar manner to impart an end-to-end rocking motion in the enclosure.

Preferably a controller is provided to control the supply of current to the solenoid coil of the actuator. Preferably the supply of current is a momentary supply of current such as a pulsed current supply. The controller suitably also includes means for selecting the time for which the current is supplied to the solenoid coil. The controller also suitably includes a device for selecting the rate at which the pulsed current is supplied to the solenoid coil. A pulsed supply of current will cause a corresponding repeated movement of the coil and therefore repeated resilient compression of the resiliently or elastically compressible device. A remote control unit may be associated with the controller for remote control of the controller and, thus, for each active leg assembly.

While the actuator as described above may be located within the resiliently compressible device, in another form, the actuator is positioned above or below the resiliently or elastically compressible device. For example the actuator may be located within a separate housing mounted to the leg member and the spring or other resiliently or elastically compressible device may be located between an intermediate support member and a lower support member, the lower support member provided above the castor wheel.

In a further preferred aspect, the present invention provides an infant enclosure of the type having legs for supporting said enclosure on an underlying surface, at least one of said legs comprising an elongated leg member having a longitudinal axis, an actuator having an actuator member adapted when the actuator is actuated to move longitudinally relative to the longitudinal axis, a resiliently or elastically compressible device adapted in use to be resiliently compressed upon movement of the actuating member to impart a motion to the leg member and thereby to said enclosure, and a device for selectively actuating said actuator means.

Preferably others of the legs of the enclosure comprise an elongated leg member and resiliently or elastically compressible device, the resiliently or elastically compressible device being adapted to facilitate the continuation of motion in the enclosure imparted by the actuator of the at least one leg of the enclosure. Preferably the resiliently or elastically compressible device comprises a compression spring, the compression spring being aligned with the longitudinal axis of the leg member. Castor wheels are suitably provided at the lower ends of the leg members for supporting the infant enclosure on an underlying surface.

In another preferred aspect, the present invention provides an infant enclosure of the type having at least three leg assemblies by which the enclosure is normally supported on an underlying surface, each said leg assembly comprising an elongated leg member having a longitudinal axis and resiliently or elastically compressible device associated with each leg member in alignment with its longitudinal axis, at least one of the leg assemblies including a solenoid actuator for causing when actuated, repeated resilient compression of the resilient or elastically compressible device of one leg assembly for imparting a substantially vertical oscillating or reciprocating motion to one leg member of said enclosure, the solenoid actuator having first and second actuator members, one of the actuator members being connected to the leg member and being oriented substantially vertically and, the other actuator member being movable substantially vertically relative to one actuator member when the actuator is actuated to thereby cause compression of said resiliently or elastically compressible device and the resiliently or elastically compressible device of the other leg assemblies causing movement of the other leg members of the enclosure upon motion being imparted to one of the leg members of the enclosure by the solenoid actuator of one leg assembly to continue motion of the enclosure, and the device for selectively actuating said solenoid actuator.

The actuator members of the solenoid actuator suitably comprise an armature and a coil, the armature being substantially vertically oriented and being connected to the leg member the coil being movable along the armature when the actuator is actuated.

The present invention in yet a further aspect provides an infant enclosure having at least three leg assemblies by which the enclosure is normally supported on an underlying surface, each leg assembly having a leg member having a longitudinal axis and a resiliently or elastically compressible device associated with one leg member and providing independent support for each of the leg members on the underlying surface, each resiliently or elastically compressible device comprising a resiliently compressible spring, one of the leg assemblies comprising an active leg assembly, and the other leg assemblies comprising passive leg assemblies, the active leg assembly including an actuator having a substantially vertically oriented actuator member, the actuator member being movable longitudinally of the longitudinal axis of the leg member of the active leg assembly, and the device for selectively actuating the actuator causing reciprocating or oscillating movement of the actuator member, the movement of the actuator member causing repeated resilient compression of the spring of the active leg assembly to impart a substantially vertical oscillating or reciprocating motion to the leg member of the active leg assembly of the enclosure, and wherein the springs of the passive leg assemblies facilitating the continuation of motion imparted in the enclosure by at least one active leg assembly.

In yet a further aspect, the present invention provides a castor wheel assembly adapted to be mounted to a leg of an infant enclosure, said leg having a longitudinal axis, and said castor wheel assembly including actuator means having an actuator member adapted when said actuator means is actuated to move longitudinally relative to said longitudinal axis, resiliently or elastically compressible means adapted in use to be resiliently compressed upon movement of said actuating member to impart a motion to said leg in said enclosure, and a castor wheel for supporting said leg on a supporting surface.

In one form, a plurality of castor wheels are provided, the castor wheels being arranged laterally relative to the longitudinal axis of the leg being circumferentially spaced from each other Preferably the castor wheel assembly includes first and second support members, and the resiliently or elastically compressible device which suitably comprise a compression spring is located between the first and second support members, and the castor wheel is mounted to the second support member in alignment with the longitudinal axis of the leg.

BRIEF DESCRIPTION OF THE DRAWINGS

Reference will now be made to the accompanying drawings which illustrate a preferred embodiment of the invention in association with a cot or crib. The present invention however may be used in association with other infant enclosures and thus the following description is not to be considered as limiting on the application of the invention. In the drawings.

DETAILED DESCRIPTION OF THE PREFERRED EMBODIMENT

Figure 1:
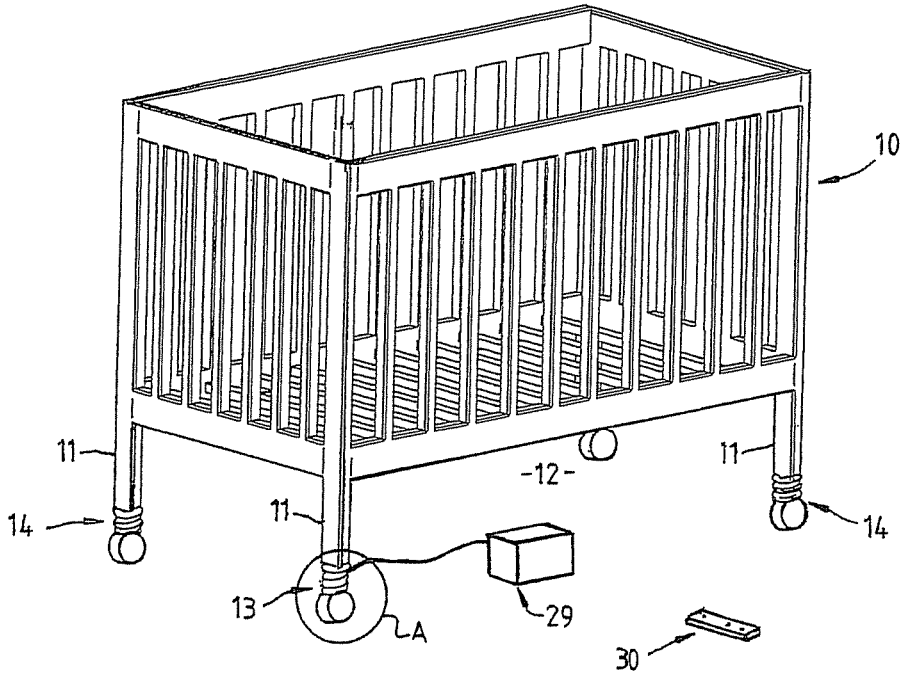
FIG. 1 illustrates a cot or crib provided with a plurality of leg assemblies according to an embodiment of the invention, at least one of which comprises an active leg assembly.

Referring to the drawings and firstly to FIG. 1, there is illustrated a cot or crib 10 which typically, and as is conventional, has four upright elongated legs each, corner normally providing a four point support for the cot 10 on an underlying surface 12 such as a floor surface. In accordance with an embodiment of the invention, the legs of the cot or crib are defined by upright leg members 11, each leg member 11 having a longitudinal axis X-X (see FIGS. 2 and 3). Positioned at the lower end of each leg member 11 and between a leg member 11 and the floor surface 12 are respective foot units comprising in this embodiment castor wheel assemblies 13 and 14, the or each castor wheel assembly 13 comprising an "active" castor wheel assembly and the or each castor wheel assembly 14 comprising "passive" castor wheel assembly. In the illustrated embodiment, three passive castor wheel assemblies 14 and one active castor wheel assembly 13 are associated with the respective legs 11.

Figure 2:
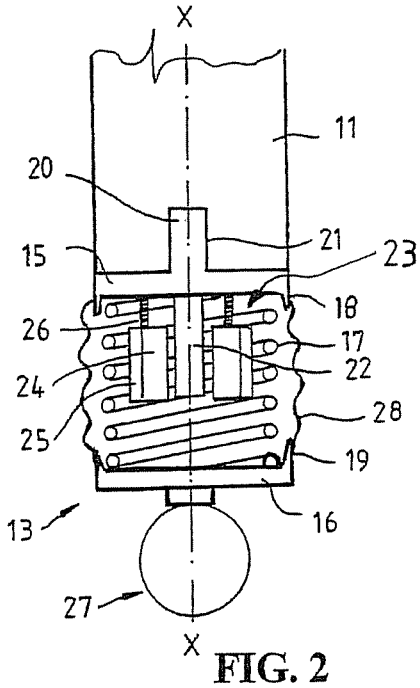
FIG. 2 is a sectional view of the region A of FIG. 1 showing details of the active leg assembly.

The castor wheel assembly 13 includes as shown in FIG. 2, an upper support member 15 and a lower support member 16 spaced along the longitudinal axis X-X from the upper support member 15 and a compression spring 17 is positioned between and connected to the members 15 and 16 to bias or normally hold the members 15 and 16 apart, the compression spring 17 being located coaxially relative to the axis X-X of the leg 11. The members 15 and 16 include downwardly and upwardly directed peripheral skirts 18 and 19 respectively within which the spring 17 is located and which serve to constrain and guide movement of the spring 17 between the members 15 and 16.

The upper support member 15 has a periphery similar to the cross section of the leg member 11 includes an upwardly extending centrally positioned locating pin or spigot 20 which extends into a central bore 21 extending along the axis X-X in the lower end of the leg 11 which locates and connects the castor wheel assembly 13 relative to the leg member 11 at the lower end thereof. For this purpose, the pin or spigot 20 is a firm frictional fit in the bore 21 which secures the support member 15 to the leg member 11.

Depending downwardly and centrally from the upper support member 15 is an armature 22 of a solenoid actuator 23 which also extends along the axis X-X and the coil 24 of the actuator 23 is located freely and coaxially about the armature 22. The coil 24 is additionally weighted by a weight 25 which surrounds and is fixed to the coil 24 to increase the momentum of the coil 24 when the actuator 23 is operated. Suspension springs 26 connected to the upper support member 15 and coil 24 suspend and support the coil 24 from the support member 15. The armature may be formed integrally with the member 15 or may be rigidly fixed to the member 15.

A conventional castor wheel 27 is pivotally mounted to the lower support member 16 in alignment with the axis X-X and a flexible boot 28 formed of rubber or a similar material is located between the upper and lower support members 15 and 16 to surround the spring 17 and the solenoid actuator 23 to prevent access thereto unless removed.

The solenoid 23 is connected to a controller 29 which can supply pulses of current to the solenoid coil 24. The controller 29 may be either connected to mains power or may be battery powered and for this purpose may include a battery therein. The controller 29 may be operated under the control of a hand held remote control unit 30. The controller 29 includes circuitry for generating a pulsed current supply and is connected to the actuator 23. When activated, the controller 29 supplies pulsed current to the actuator 23 at a controlled rate to thereby control the rate of reciprocation of the coil 24 and attached weight 25 relative to the armature 22. The controller 29 also includes a timing circuit to control the time for which current is supplied to the actuator 23

Figure 3:
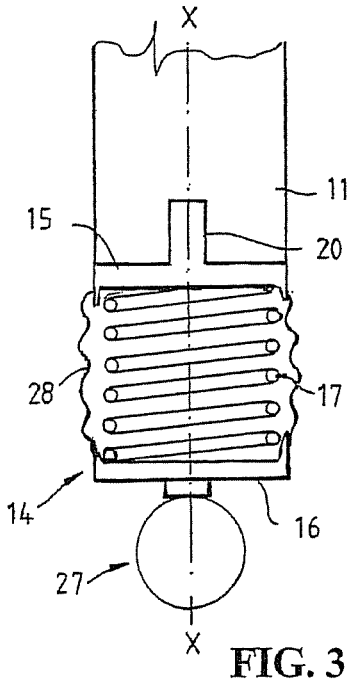
FIG. 3 is a sectional view of a passive leg assembly.

The passive castor wheel assembly 14 as shown in FIG. 3 is of similar construction to the active assembly 13 and like components have been given like numerals. In the passive assemblies 14 however, a solenoid 23 is not included with the castor wheel assembly 14 simply providing through the spring 17 located coaxially of the axis X-X of the leg member 11, a spring mounting for a leg member 11. The springs 17 of the respective castor wheel assemblies 13 and 14 thus provide independent resilient supports for each leg member 11 on the surface 12.

In use, when current is supplied by the controller 29 to the coil 24 of the solenoid actuator 23 to energize the coil 24, a magnetic field will be created by the coil 24 which causes the coil 24 by cooperation with the armature 22 to move substantially vertically upwardly. Removal of current from the coil 24 will de-energize the coil 24 thereby allowing the coil 24 to drop downwardly under the influence of gravity back towards its neutral position. The suspension springs 26 cushion the dropping movement of the coil 24 and attached weight 25 so that the coil 24 bounces or reciprocates up and down until it reaches an at rest position. The momentum created by the initial dropping movement of the coil 24 and weight 25 will cause the spring 17 to be initially compressed and the spring 17 will thereafter move back or expand towards its non-compressed position. This movement is transmitted to the leg member 11 of the cot 10 as a vertical movement. Repeated movement of the coil 24 by repeated momentary or pulsed supply of current to the actuator 23 from the controller 29 will create a vibratory or reciprocatory movement in the spring 17 in a substantially vertical direction which is transmitted to the cot 10 through the leg member 11 as an up and down movement of the leg member 11. Due to the spring mounting of the other three leg members 11 provided by the passive castor wheel assemblies 14, the momentary vertical force applied to the one leg member 11 by the active castor wheel assembly 13 will induce an oscillating or rocking motion in the cot 10 and the springs 17 of the assemblies 14 will facilitate the continuation of the reciprocating or oscillating motion of the cot 10. Thus when the leg member 11 supported by one castor wheel assembly 13 drops as the spring 17 is compressed, the opposite diagonal leg member 11 will lift upwardly. The springs 17 of the other castor wheel assemblies 14 are compressed also during this movement and cause an undulating rocking movement of the cot 10 similar to the movement of a vehicle. The springs of the respective assemblies 13 and 14 in effect form an independent four-point suspension for the cot 10.

Continued repeated supply of pulses of current to the active castor wheel assembly 13 will continue the oscillating movement of the cot 10 at a selected desired rate. Thus the solenoid actuator 23 under the control of the controller 29 can be activated at regular intervals to maintain the oscillating or rocking motion in the cot 10. This motion created in the cot 10 will encourage a baby or infant within the cot 10 to sleep. The control circuitry of the controller 29 will cease supply of current to the solenoid actuator 23 after a predetermined period of time which can be programmed in the controller 29.

Figure 4:
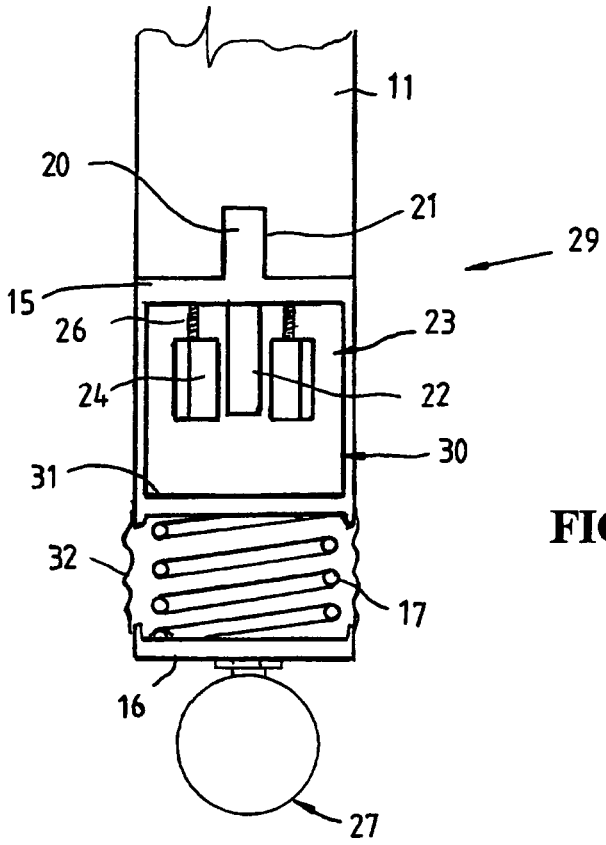
FIG. 4 is a sectional view of a further embodiment of active leg assembly.

FIG. 4 illustrates an alternative active castor wheel assembly 29 according to the invention which is similar to the castor wheel assembly 13 and again like components have been given like numerals. In this case however the spring 17 is arranged separately from the actuator 23, the actuator 23 being located within a hollow housing 30 which extends longitudinally of the axis of the leg member 11 and the spring 17 defining a suspension beneath the housing 30 supporting the housing 30 to the castor wheel 27. The top wall of the housing 30 is defined by the support member 15 while the bottom wall of the housing 30 forms an intermediate support member 31 between the upper support member 15 and lower support member 16. The spring 17 is thus positioned between the intermediate member 31 and the lower member 16. A flexible boots or boots 32 surround the spring 17 and may also extend upwardly to surround the housing 30.

The embodiment of active castor wheel assembly 29 of FIG. 4 functions in a similar manner to the embodiment of FIG. 2 with repeated actuation of the actuator 23 causing repeated reciprocation of the weighted coil 24 in opposite vertical directions with momentum of the coil 24 causing repeated compression of the spring 17 with the compression of the spring 17 and subsequent elastic expansion of the spring 17 imparting a vibratory or oscillating motion in a vertical direction to the leg member 11 and thus to the cot 10. For a passive castor wheel assembly 29, the actuator 23 is omitted.

Figure 5:
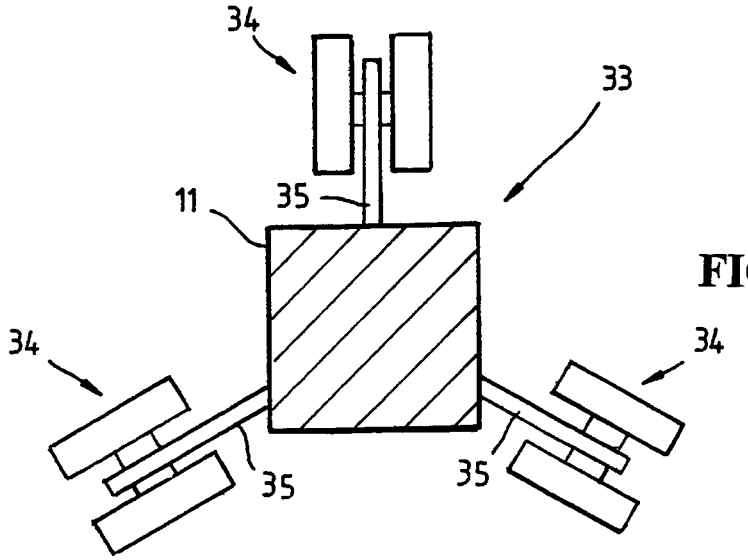
FIGS. 5 and 6 are sectional plan and side views of yet a further embodiment of the leg assembly according to the invention.
Figure 6:
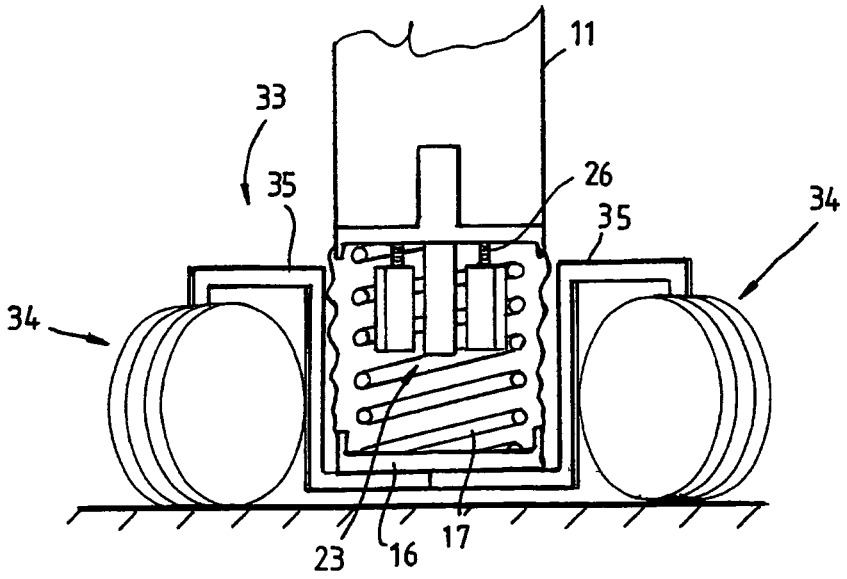

FIGS. 5 and 6 illustrate a further embodiment of active castor wheel assembly 33 according to the invention which includes a solenoid actuator 23 and spring 17 in a similar configuration to the embodiment of FIG. 2. In this case however, the single castor wheel 27 of FIG. 2 is replaced by three castor wheels 34 arranged at an equidistant circumferential spacing, in this case at 120 degrees to each other around the actuator 23. The wheels 34 are supported on brackets 35 laterally of the axis of the leg member 11 and of the actuator 23 and spring 17, the brackets 35 being mounted to or secured to the lower support member 16 of the spring 17. Alternatively the brackets 35 may define the lower support member 16. This configuration reduces the overall height of the castor wheel assembly 33 without changing the operation thereof. The castor wheel assembly 33 is an active assembly. For a passive assembly, the actuator 23 is omitted.

While the leg and castor assemblies described above are particularly suited for use with infant or baby cots, they may also be used as referred to with prams or strollers. Further while the castor assemblies 13 and 14 have been described as separate units which are attachable to the legs of an existing cot or the like, they may be incorporated within a leg of a cot of other infant enclosure. In addition, whilst the actuators of the apparatus are described as solenoid actuators, they may comprise other forms of electrical actuator. In some embodiments also it is possible to use employ mechanical actuators such as spring driven actuators.

While the embodiments of the invention have described leg assemblies described in connection with an infant enclosure. It will be appreciated however that the leg assemblies may be used in other applications to impart a movement in any other device supported by one or more leg assemblies.

The reference to prior art herein is not be taken as an admission that such prior art constitutes common general knowledge in the art.

The terms "comprising" or "comprises" as used throughout the specification and claims are taken to, specify the presence of the stated features, integers and components referred to but not preclude the presence or addition of one or more other feature/s, integer/s, component/s or group thereof.

While the above has been given by way of illustrative embodiment of the invention, all such variations and modifications thereto as would be apparent to persons skilled in the art are deemed to fall within the broad scope and ambit of the invention as defined in the appended claims.

The invention claimed is:

1. A leg assembly for use as at least one supporting leg of an infant enclosure or other device, said leg assembly having:

an elongated leg member having a longitudinal axis, actuator means having an actuator member adapted when said actuator means is actuated to move longitudinally relative to said longitudinal axis, resiliently or elastically compressible spring means arranged coaxially relative to said longitudinal axis and adapted in use to be resiliently compressed upon movement of said actuating member to impart a motion to said leg member and thereby to said enclosure or other device, means for selectively actuating said actuator means, and wherein said actuator means is located within said spring means.

2. A leg assembly as claimed in claim 1 wherein said actuator means includes first and second actuator members, one said member being fixed to said leg member and the other said member comprising the movable actuator member.

3. A leg assembly as claimed in claim 2 wherein said actuator means comprises a solenoid actuator and wherein said first and second actuator members comprise an armature and a solenoid coil.

4. A leg assembly as claimed in claim 3 wherein said armature extends coaxially relative to said longitudinal axis and wherein said coil comprises said movable actuator member which surrounds said armature.

5. A leg assembly as claimed in claim 4 wherein said coil is weighted to increase the momentum thereof when said actuator means is actuated.

6. A leg assembly as claimed in claim 5 wherein said coil is suspended by springs.

7. A leg assembly as claimed in claim 3 and including control means to control a supply of current to the solenoid coil and a remote control unit associated with said control means.

8. A leg assembly as claimed in claim 1 wherein said resiliently or elastically compressible sprinq means is provided between upper and lower support members, one of said support members being mounted to said leg member and the other said support member being longitudinally aligned with the one support member relative to the longitudinal axis of the leg member.

9. A leg assembly as claimed in claim 8 and including a castor wheel mounted to the lower support member of the leg assembly.

* * * * *